US010675727B1

(12) United States Patent
Casey

(10) Patent No.: US 10,675,727 B1
(45) Date of Patent: Jun. 9, 2020

(54) GRINDER DOLLY

(71) Applicant: Charles Casey, Haverhill, MA (US)

(72) Inventor: Charles Casey, Haverhill, MA (US)

( * ) Notice: Subject to any disclaimer, the term of this patent is extended or adjusted under 35 U.S.C. 154(b) by 219 days.

(21) Appl. No.: 15/785,618

(22) Filed: Oct. 17, 2017

(51) Int. Cl.
*B24B 23/00* (2006.01)
*B24B 23/02* (2006.01)

(52) U.S. Cl.
CPC ..... *B24B 23/005* (2013.01); *B24B 23/02* (2013.01)

(58) Field of Classification Search
CPC ..... B24B 23/005; B24B 23/02; B24B 23/04; B24B 41/02
USPC ..... 451/359, 353
See application file for complete search history.

(56) References Cited

U.S. PATENT DOCUMENTS 2,348,268 A * 5/1944 Smith ..... A47L 11/4069 15/49.1
2,447,618 A 8/1948 Nicholson
2,702,395 A * 2/1955 Zaiger ..... A47L 11/162 15/144.4
3,731,334 A * 5/1973 Carbonell ..... A47L 11/283 15/50.1
3,871,137 A * 3/1975 Grammatico ..... B24B 23/005 451/340
4,133,072 A * 1/1979 Face, Jr. ..... A47L 11/30 15/353
4,182,001 A * 1/1980 Krause ..... A47L 11/34 15/320
4,769,201 A * 9/1988 Chiuminatta ..... B24B 19/02 264/154
4,783,872 A * 11/1988 Burhoe ..... A47L 11/162 15/49.1
5,407,380 A 4/1995 Salkewicz
5,870,791 A * 2/1999 Gurstein ..... A47L 11/162 15/49.1
6,120,362 A 9/2000 Etter
6,478,666 B1 * 11/2002 Berger ..... B24B 19/02 125/13.01
7,000,605 B2 * 2/2006 Due ..... B28D 1/045 125/13.01
7,080,851 B2 * 7/2006 Schipper ..... B24B 27/08 280/47.2
7,247,085 B1 * 7/2007 Anderson ..... A47L 11/162 15/340.1
7,261,623 B1 * 8/2007 Palushi ..... B24B 7/186 451/350
7,597,610 B2 * 10/2009 Stoll ..... B24B 23/005 451/350
7,850,510 B2 12/2010 Hersgren
7,905,223 B2 * 3/2011 von Siegroth ..... B24B 27/08 125/13.01
D655,593 S 3/2012 Wagner, III
8,282,445 B2 * 10/2012 Goldberg ..... A47L 11/16 451/350

(Continued)

*Primary Examiner* — George B Nguyen

(57) ABSTRACT

The grinder dolly is configured for use with a disk grinder. The disk grinder further comprises a grinder motor and a grinding disk. The grinder dolly is a wheeled bracket. The disk grinder attaches to the grinder dolly such that the grinding disk can be used to grind or polish a supporting surface. The grinder dolly comprises a handle, a plurality of wheels, and a power distribution system. The disk grinder attaches to the handle. The plurality of wheels are used to roll the disk grinder over the supporting surface. The power distribution system provides electrical energy to the disk grinder.

10 Claims, 7 Drawing Sheets

(56) References Cited

U.S. PATENT DOCUMENTS

| | | | | |
|---|---|---|---|---|
| 9,056,381 | B1 | 6/2015 | Airosa | |
| 9,351,622 | B2 * | 5/2016 | Bruders | A47L 11/4044 |
| 9,561,574 | B2 * | 2/2017 | Wisenbaker | B24B 23/005 |
| 10,029,341 | B2 * | 7/2018 | Berg | B24B 7/18 |
| 2014/0369019 | A1 * | 12/2014 | Sabia | B24B 23/005<br>361/828 |

* cited by examiner

GRINDER DOLLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping including grinding and polishing, more specifically, an accessory configured for use with a device for grinding a plane surface.

SUMMARY OF INVENTION

The grinder dolly is configured for use with a disk grinder. The disk grinder further comprises a grinder motor and a grinding disk. The grinder dolly is a wheeled bracket. The disk grinder attaches to the grinder dolly such that the grinding disk can be used to grind or polish a supporting surface. The grinder dolly comprises a handle, a plurality of wheels, and a power distribution system. The disk grinder attaches to the handle. The plurality of wheels are used to roll the disk grinder over the supporting surface. The power distribution system provides electrical energy to the disk grinder.

These together with additional objects, features and advantages of the grinder dolly will be readily apparent to those of ordinary skill in the art upon reading the following detailed description of the presently preferred, but nonetheless illustrative, embodiments when taken in conjunction with the accompanying drawings.

In this respect, before explaining the current embodiments of the grinder dolly in detail, it is to be understood that the grinder dolly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the grinder dolly.

It is therefore important that the claims be regarded as including such equivalent construction insofar as they do not depart from the spirit and scope of the grinder dolly. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
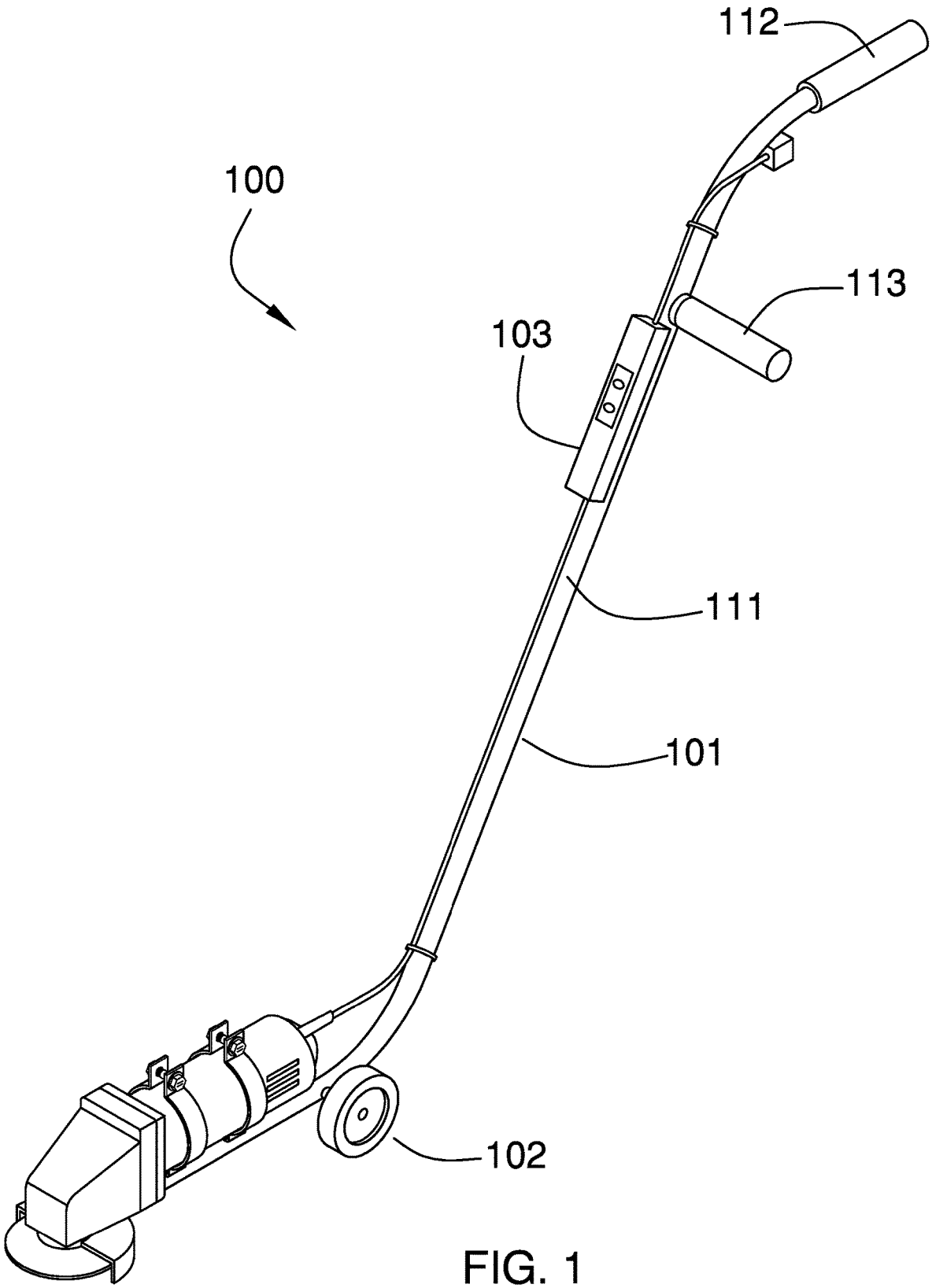
FIG. 1 is a perspective view of an embodiment of the disclosure.
Figure 2:
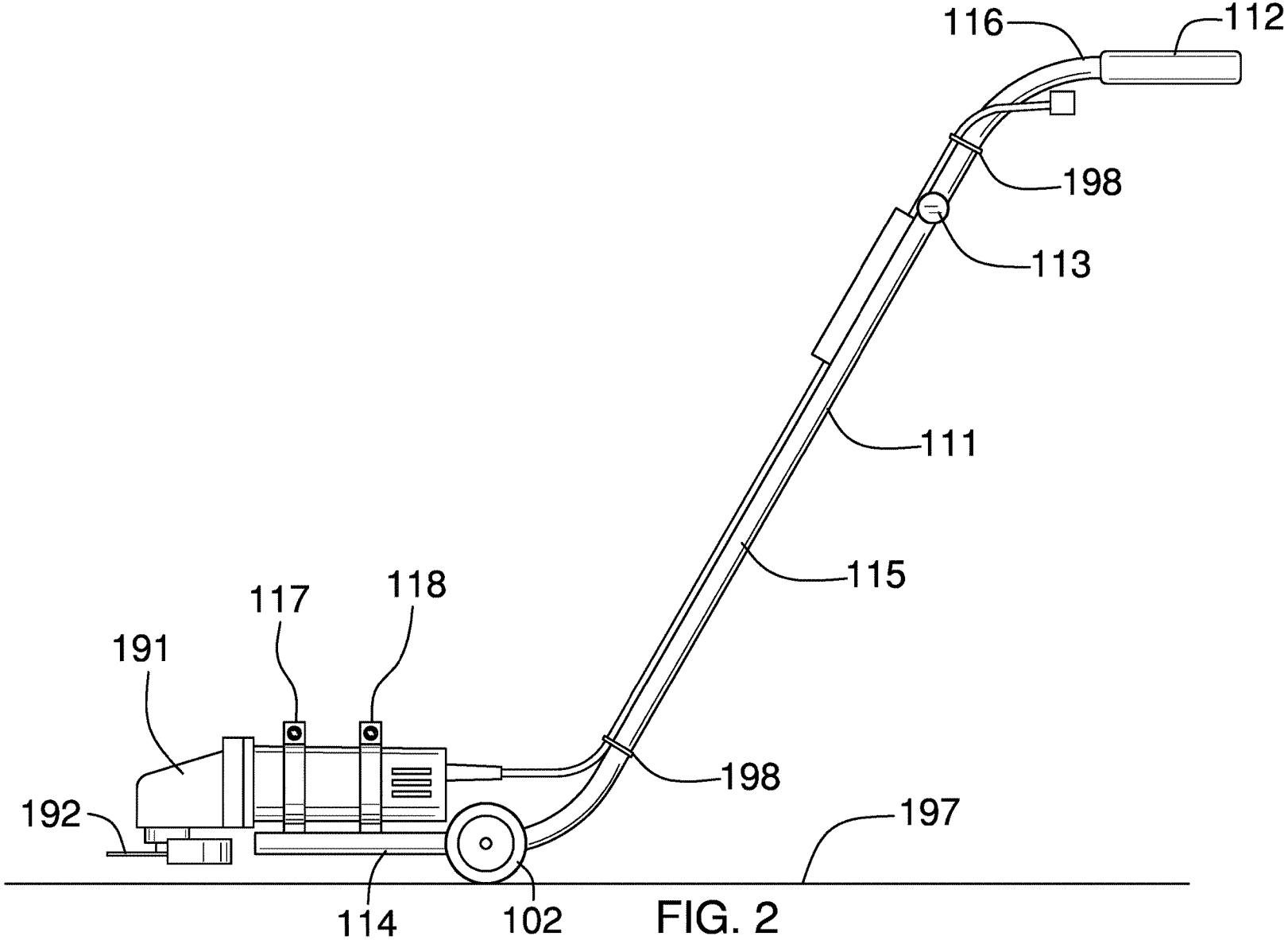
FIG. 2 is a side view of an embodiment of the disclosure.
Figure 3:
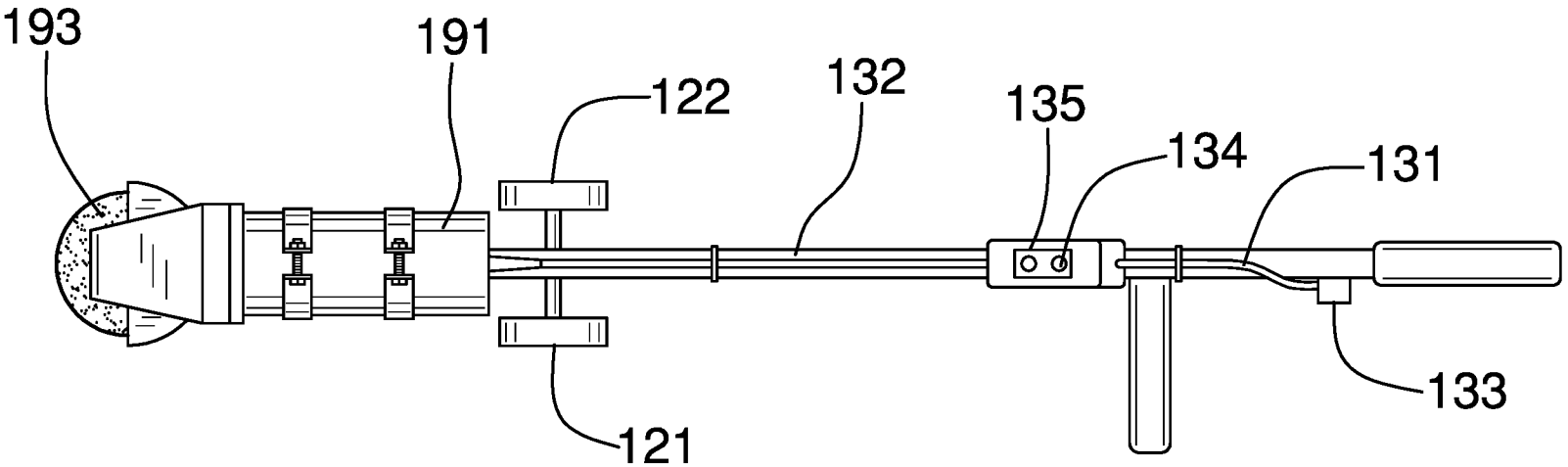
FIG. 3 is a top view of an embodiment of the disclosure.
Figure 4:
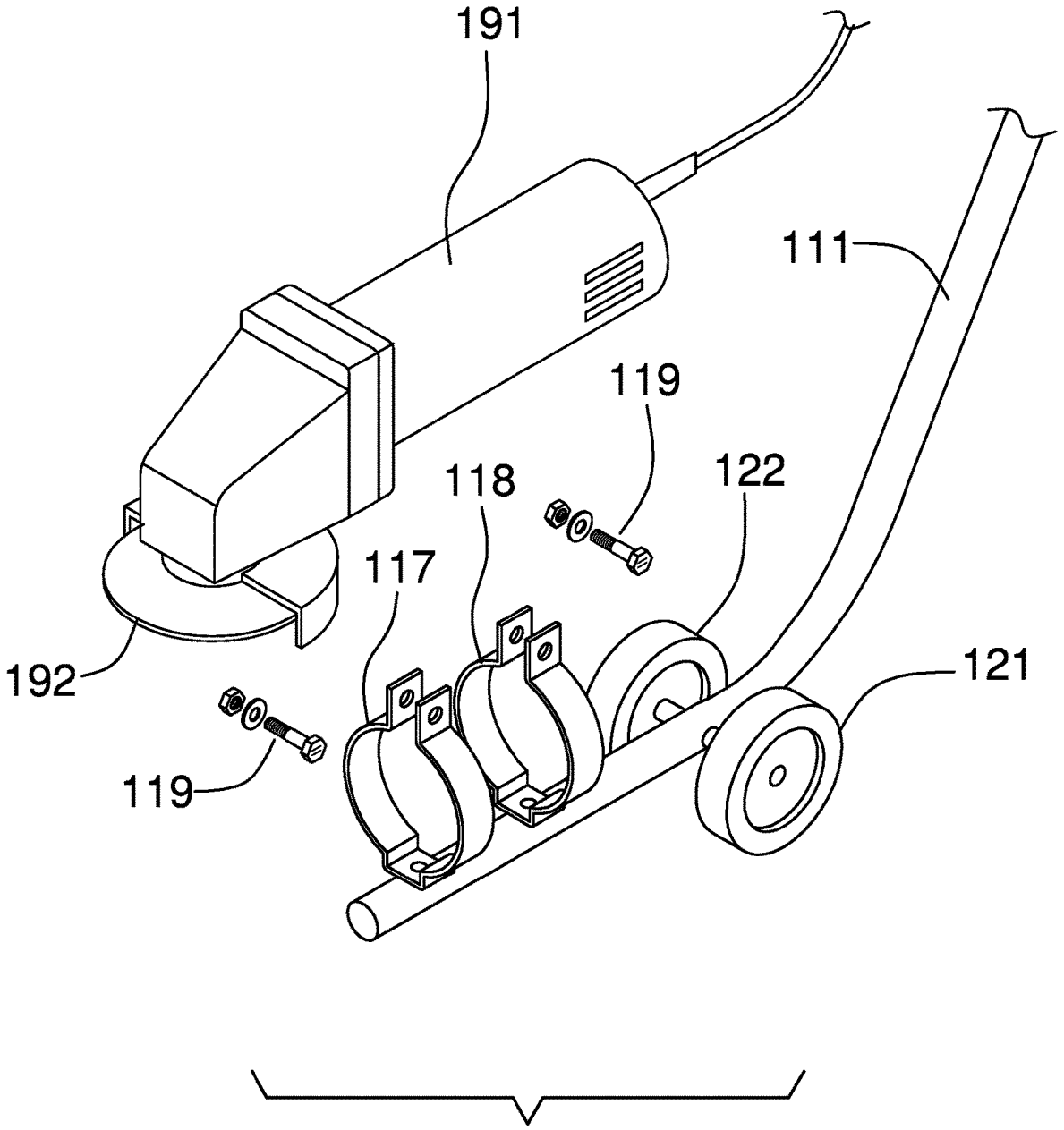
FIG. 4 is an exploded view of an embodiment of the disclosure.
Figure 5:
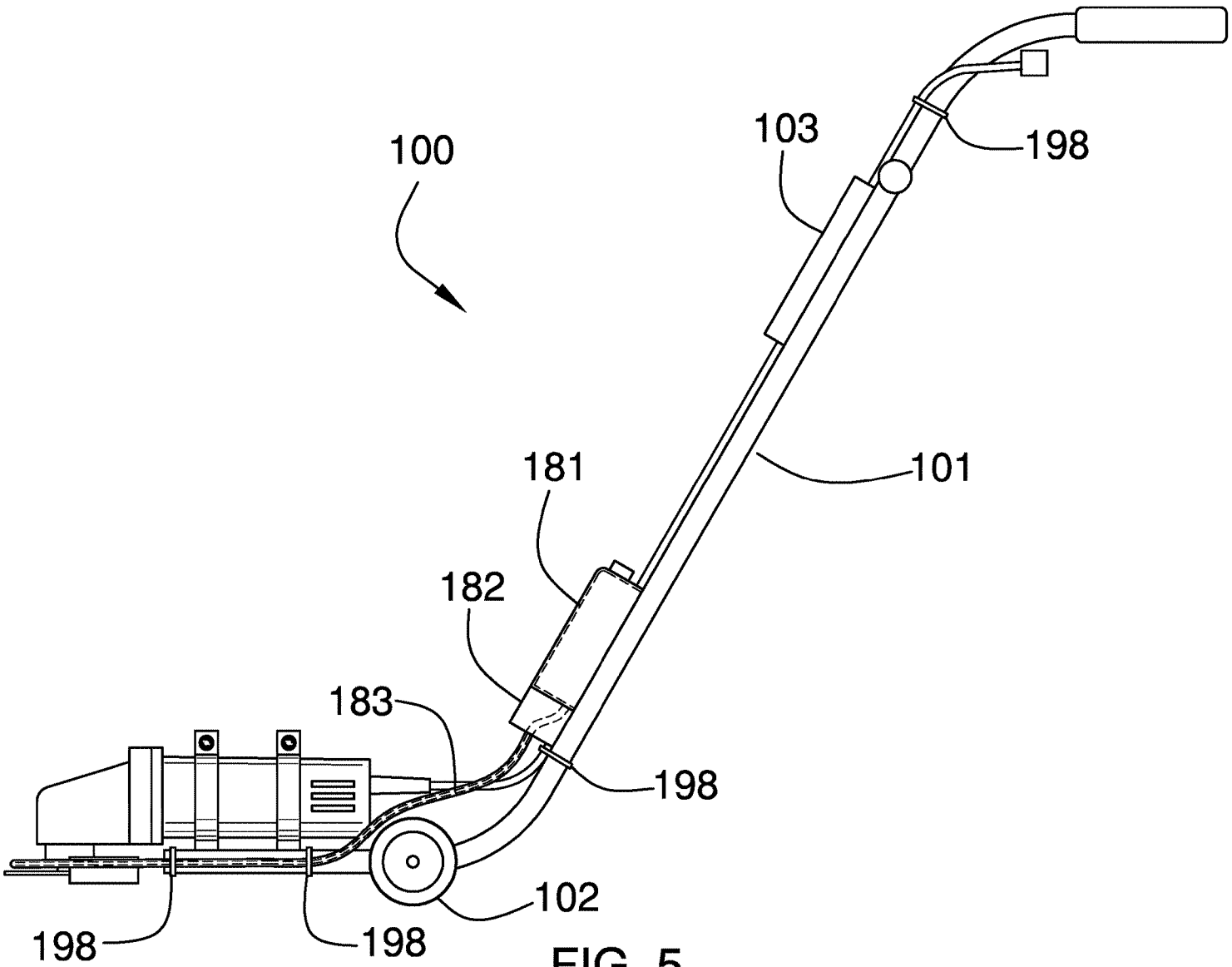
FIG. 5 is a reverse side view of an embodiment of the disclosure.
Figure 6:
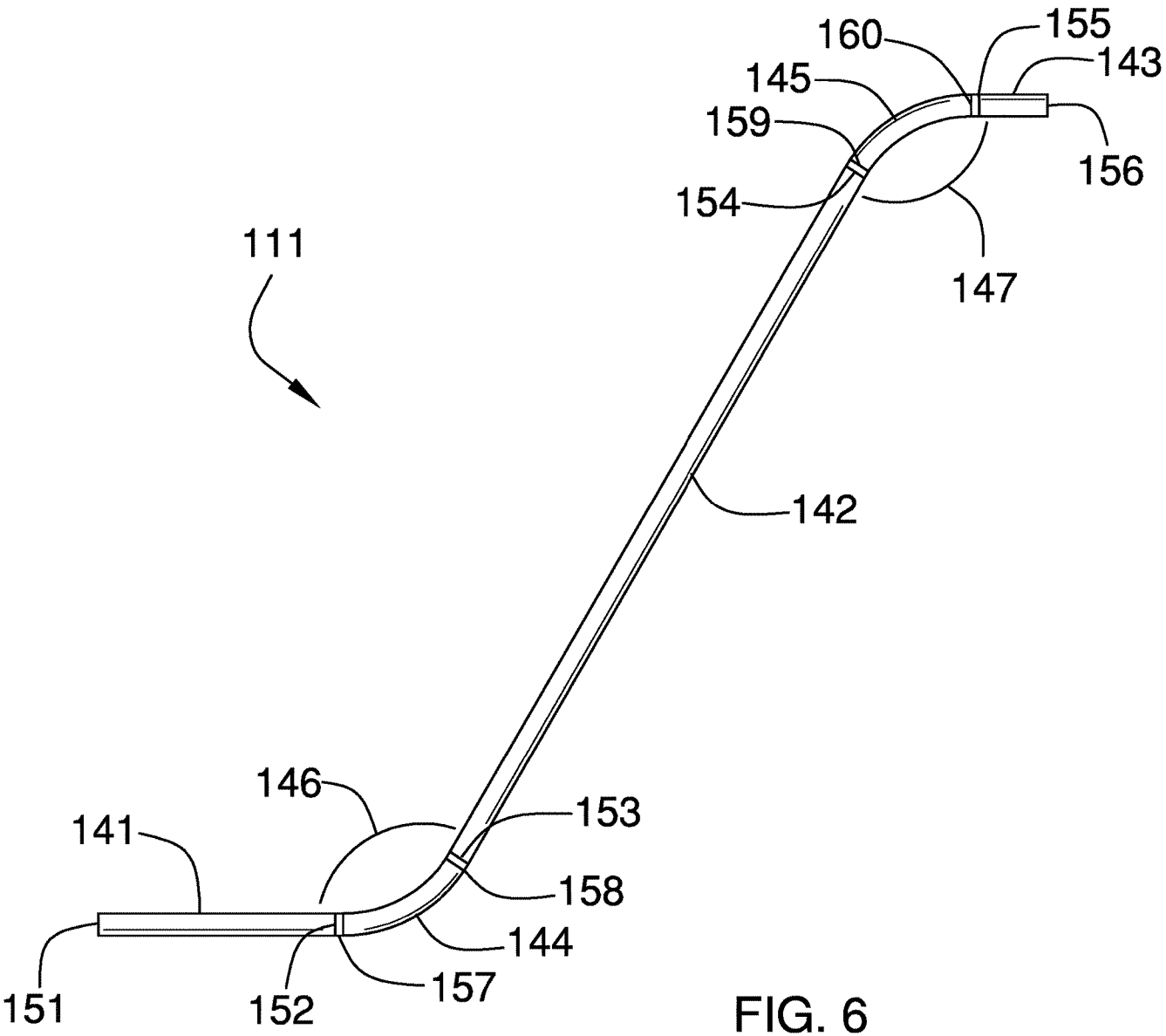
FIG. 6 is a detail view of an embodiment of the disclosure.
Figure 7:
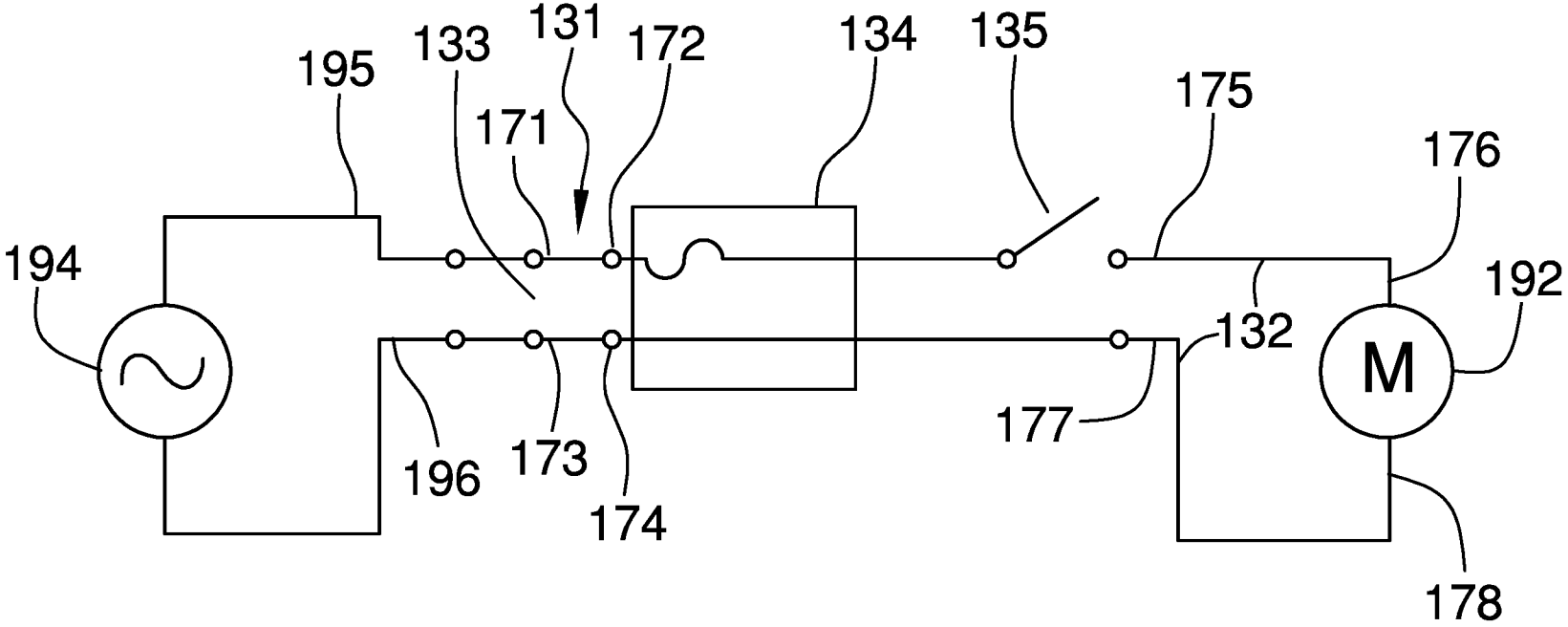
FIG. 7 is a schematic view of an embodiment of the disclosure.

Detailed reference will now be made to one or more potential embodiments of the disclosure, which are illustrated in FIGS. 1 through 7.

The grinder dolly 100 (hereinafter invention) is configured for use with a disk grinder 191. The disk grinder 191 further comprises a grinder motor 192 and a grinding disk 193. The invention 100 is a wheeled bracket. The disk grinder 191 attaches to the invention 100 such that the grinding disk 193 can be used to grind or polish a supporting surface. The invention 100 comprises a handle 101, a plurality of wheels 102, and a power distribution system 103. The disk grinder 191 attaches to the handle 101. The plurality of wheels 102 are used to roll the disk grinder 191 over the supporting surface. The power distribution system 103 provides electrical energy from an external power source 194 to the grinder motor 192 of the disk grinder 191.

The disk grinder 191 is a portable power tool that is used to cut or polish a surface. The grinder motor 192 is an electrical motor provisioned with the disk grinder 191. The grinder motor 192 rotates the grinding disk 193. The grinding disk 193 is a disk structure coated with an abrasive material. The grinding disk 193 forms the cutting and polishing surface of the disk grinder 191.

The handle 101 is a nonlinear prism structure: 1) upon which the disk grinder 191 mounts; and, 2) which is used to manipulate the disk grinder 191 when the invention 100 is in use. The handle 101 comprises a canted pipe 111, an end grip 112, and a side grip 113. The canted pipe 111 is further defined with a first cant 146 and a second cant 147.

In the first potential embodiment of the invention 100, the handle 101 is formed from commercially available cylindrical pipes and fittings. Within this disclosure, this selection is highlighted for the purposes of simplicity and clarity of exposition of the disclosure is not intended to limit the scope of the appended claims. Those skilled in the art will recognize that the innovations described in this disclosure can be readily modified to accommodate any tubular prism structure with a minimum of modification and experimentation.

The canted pipe 111 is a curved tubular prism structure. The plurality of wheels 102, the power distribution system 103, and the disk grinder 191 attach to the canted pipe 111. The end grip 112 is a commercially available non-slip handlebar grip. The end grip 112 attaches to an end of the canted pipe 111. The side grip 113 is a cylindrical shaft that attaches to the canted pipe 111. The side grip 113 mounts perpendicularly to the end grip 112.

The canted pipe 111 comprises a grinder yoke 114, an extension structure 115, and a grip yoke 116. The grinder yoke 114 comprises a first fastener 117, a second fastener 118, and associated hardware 119.

The grinder yoke 114 is the inferior structure of the canted pipe 111. The plurality of wheels 102 and the disk grinder 191 attach to the grinder yoke 114. During normal use of the invention 100, the center axis of the grinder yoke 114 is parallel to the supporting surface 197. The grip yoke 116 is the superior structure of the canted pipe 111. The grip yoke 116 is a raised structure that allows the disk grinder 191 to be used on a supporting surface 197 without stooping or bending. The center axis of the grip yoke 116 is parallel to the center axis of the grinder yoke 114.

The extension structure 115 is an inert structure that separates the grinder yoke 114 and the grip yoke 116. The center axis of the extension structure 115 intersects with the center axes of the grinder yoke 114 and the grip yoke 116 to form the first cant 146 and the second cant 147.

The first fastener 117 is a commercially available pipe rail tie. The first fastener 117 attaches the disk grinder 191 to the grinder yoke 114. The second fastener 118 is a commercially available pipe rail tie. The second fastener 118 attaches the disk grinder 191 to the grinder yoke 114. The first fastener 117 attaches to the superior side of the grinder yoke 114. The second fastener 118 attaches to the superior side of the grinder yoke 114. The associated hardware 119 is used to secure the first fastener 117 and the second fastener 118 to the disk grinder 191. In the first potential embodiment of the disclosure, the selected associated hardware 119 comprises commercially available nuts and bolts.

In the first potential embodiment of the disclosure, the canted pipe 111 further comprises a first pipe 141, a second pipe 142, a third pipe 143, a first 45-degree elbow 144, and a second 45-degree elbow 145. The first pipe 141 is further defined with a first port 151 and a second port 152. The second pipe 142 is further defined with a third port 153 and a fourth port 154. The third pipe 143 is further defined with a fifth port 155 and a sixth port 156. The first 45-degree elbow 144 is further defined with a seventh port 157 and an eighth port 158. The second 45-degree elbow 145 is further defined with a ninth port 159 and a tenth port 160.

The first pipe 141 is a readily and commercially available cylindrical metal pipe. The second pipe 142 is a readily and commercially available cylindrical metal pipe. The third pipe 143 is a readily and commercially available cylindrical metal pipe. The outer diameters of the first pipe 141, the second pipe 142, and the third pipe 143 are identical.

The first 45-degree elbow 144 is a readily and commercially available cylindrical metal 45-degree elbow. The inner diameter of the first 45-degree elbow 144 is sized to receive the first pipe 141 and the second pipe 142. The second 45-degree elbow 145 is a readily and commercially available cylindrical metal 45-degree elbow. The inner diameter of the second 45-degree elbow 145 is sized to receive the third pipe 143 and the second pipe 142.

The first cant 146 is the acute angle formed between the center axis of the first pipe 141 and the second pipe 142. The measure of the first cant 146 is determined by the first 45-degree elbow 144. The second cant 147 is the acute angle formed between the center axis of the third pipe 143 and the second pipe 142. The measure of the second cant 147 is determined by the second 45-degree elbow 145. The center axes of the first pipe, the second pipe, the third pipe, the first 45-degree elbow, and the second 45-degree elbow share the same plane The plurality of wheels 102 are attached to the handle 101. The plurality of wheels 102 allow the disk grinder 191 to be rolled along the supporting surface 197. The plurality of wheels 102 comprises a first wheel 121 and a second wheel 122. The first wheel 121 is a readily and commercially available wheel. The second wheel 122 is a readily and commercially available wheel.

The power distribution system 103 is an electrical switching and safety system that transfers electrical energy from an external power source 194 to the disk grinder 191. The power distribution system 103 comprises a first cable 131, a second cable 132, a plug 133, a ground fault interrupter 134, and a master switch 135.

The first cable 131 is a readily and commercially available electrical cable comprising at least two metal wire conductors. The first cable 131 is further defined with a first termination 171, a second termination 172, a third termination 173, and a fourth termination 174. The first termination 171 and the second termination 172 form a first conductor of the first cable 131. The third termination 173 and the fourth termination 174 form a second conductor of the first cable 131.

The second cable 132 is a readily and commercially available electrical cable comprising at least two metal wire conductors. The second cable 132 is further defined with a fifth termination 175, a sixth termination 176, a seventh termination 177, and an eighth termination 178. The fifth termination 175 and the sixth termination 176 form a third conductor of the second cable 132. The seventh termination 177 and the eighth termination 178 form a fourth conductor of the second cable 132.

The plug 133 is a commercially available electrical device that connects the power distribution system 103 to the external power source 194. In the first potential embodiment of the disclosure, the plug 133 is a NEMA 5-15 electrical plug. The external power source 194 is an externally provided source of electric power. The external power source 194 is further defined with a hot connection 195 and a neutral connection 196. In the first potential embodiment of the disclosure, the external power source 194 is assumed to be the national electric grid. The hot connection 195 is a connection to the external power source 194 that provides an alternating voltage potential. The neutral connection 196 is a connection to the external power source 194 that provides a constant voltage potential that acts as a current "drain."

The ground fault interrupter 134 is an electrical device that disables the operation of the invention 100 should an electrical ground fault be detected. The use of a ground fault interrupter 134 is well-known and documented in the electrical arts. The ground fault interrupter 134 is discussed in greater detail elsewhere in this disclosure.

The master switch 135 is a commercially available single pole single throw maintained switch. The master switch 135 is used as a power switch that enables and disables the operation of the invention 100.

In a second potential embodiment of the disclosure, the invention 100 further comprises a reservoir 181, a pump 182, and a hose 183. The reservoir 181 and the pump 182 attach to the extension structure 115 using the plurality of cable ties 198. The hose 183 attaches to the extension structure 115 and the grinder yoke 114 using the plurality of cable ties 198.

The reservoir 181 is a bottle that contains a rinsing fluid. The rinsing fluid is used to clean the grinding disk 193 of the disk grinder 191 during use of the invention 100. The pump 182 is a commercially available device that provides the pressure differentials to move the reservoir 181 fluid to the grinding disk 193. The hose 183 is a flexible tubing that transports the reservoir 181 fluid from the reservoir 181 to the grinding disk 193.

The assembly of the invention 100 is described in the following five paragraphs.

The first fastener 117 attaches to the grinder yoke 114 using commercially available hardware. The second fastener 118 attaches to the grinder yoke 114 using commercially available hardware. The first fastener 117 and the second fastener 118 attach the disk grinder 191 to the grinder yoke 114 of the canted pipe 111. The associated hardware 119 secures the disk grinder 191 to the first fastener 117 and the second fastener 118. The first wheel 121 attaches to the first 45-degree elbow 144. The second wheel 122 attaches to the first 45-degree elbow 144.

The second port 152 of the first pipe 141 attaches to the seventh port 157 of the first 45-degree elbow 144. The third port 153 of the second pipe 142 attaches to the eighth port 158 of the first 45-degree elbow 144. The fourth port 154 of the second pipe 142 attaches to the ninth port 159 of the second 45-degree elbow 145. The fifth port 155 of the fourth port 154 attaches to the tenth port 160 of the second 45-degree elbow 145. The end grip 112 attaches to the sixth port 156 of the third pipe 143. The end grip 112 slides over the sixth port 156. The first 45-degree elbow 144 forms the first cant 146 of the canted pipe 111. The second 45-degree elbow 145 forms the second cant 147 of the canted pipe 111.

The side grip 113 attaches to the face of the second pipe 142 such that the grip projects radially away from the side grip 113 projects radially away from the second pipe 142. Commercially available hardware attaches the side grip 113 to the second pipe 142. The plurality of cable ties 198 attach the first cable 131 to the second pipe 142. The plurality of cable ties 198 attach the second cable 132 to the second pipe 142.

The plug 133 electrically connects the hot connection 195 of the external power source 194 to the first termination 171 of the first cable 131. The plug 133 electrically connects the neutral connection 196 of the external power source 194 to the third termination 173 of the first cable 131.

The second termination 172 of the first cable 131 electrically connects to the ground fault interrupter 134. The fourth termination 174 of the first cable 131 electrically connects to the ground fault interrupter 134. The ground fault interrupter 134 electrically connects to the master switch 135. The master switch 135 electrically connects to the fifth termination 175 of the second cable 132. The ground fault interrupter 134 electrically connects to the seventh termination 177 of the second cable 132. The sixth termination 176 of the second cable 132 electrically connects to the grinder motor 192. The eighth termination 178 of the second cable 132 electrically connects to the grinder motor 192.

The following definitions were used in this disclosure:

45 Degree Elbow: As used in this disclosure, a 45-degree elbow is a two aperture fitting that attaches a first pipe to a second pipe such that the center axis of the first pipe forms a 45-degree angle relative to the center axis of the second pipe.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cable: As used in this disclosure, a cable is a collection of insulated wires covered by a protective casing used for transmitting electricity or telecommunication signals.

Cable Tie: As used in this disclosure, a cable tie is a type of fastener that is used to tie two objects together. The cable tie has a box end and an open end. The box end further comprises a gear like structure wherein when the open end inserts into the gear like structure, the gear like structure acts as a ratchet that prevents the open end from being removed from the gear like structure.

Cant: As used in this disclosure, a cant is an angular deviation from one or more reference planes such as a vertical plane or a horizontal plane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Circuit Breaker: As used in this disclosure, a circuit breaker is a normally closed maintained switch that automatically actuates to an open position should a dangerous condition (such as overcurrent or ground fault) be detected.

Cylinder: As used in this disclosure, a cylinder is a geometric structure defined by two identical flat and parallel ends, also commonly referred to as bases, which are circular in shape and connected with a single curved surface, referred to in this disclosure as the face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment (or a radial line) that passes through the center (or center axis) of an object. The line segment of the diameter terminates at the perimeter or boundary of the object through which the line segment of the diameter runs.

Disk: As used in this disclosure, a disk is a cylindrically shaped object that is flat in appearance.

Electric Motor: In this disclosure, an electric motor is a machine that converts electric energy into rotational mechanical energy.

Extension Structure: As used in this disclosure, an extension structure is an inert physical structure that is used to extend the span of the distance between any two objects.

External Power Source: As used in this disclosure, an external power source is a source of the energy that is externally provided to enable the operation of the present disclosure. Examples of external power sources include, but are not limited to, electrical power sources and compressed air sources.

Grip: As used in this disclosure, a grip is an accommodation formed in or on an object that allows the object to be grasped or manipulated by a hand.

Ground Fault Interrupter: As used in this disclosure, a ground fault interrupter is a circuit breaker that is actuated when a "ground fault" is detected. The ground fault interrupter is inserted into a protected electrical circuit such that all authorized electrical currents entering and leaving the protected electrical circuit are routed through the ground fault interrupter. The ground fault interrupter detects the ground fault by comparing the current entering protected electrical circuit through the ground fault interrupter and the current exiting the protected electrical circuit through the ground fault interrupter. Should a current mismatch be detected, the ground fault interrupter actuates to the open position. A ground fault interrupter is also referred to as a ground fault circuit interrupter.

Hand Tools or Portable Power Tools: As used in this disclosure, a hand tool or a portable power tool is considered to be a device that is classified, or would reasonably be expected to be classified, within the Cooperative Patent Classification system in the B25 grouping.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hose: As used in this disclosure, a hose is a flexible hollow cylindrical device used for transporting liquids and gases. When referring to a hose in this disclosure, the terms inner diameter and outer diameter are used as they would be used by those skilled in the plumbing arts.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into mechanical energy.

National Electric Grid: As used in this disclosure, the national electric grid is a synchronized and highly interconnected electrical network that distributes energy in the form of electric power from a plurality of generating stations to consumers of electricity.

NEMA 5-15P Electrical Plug: As used in this disclosure, the NEMA 5-15P Electrical Plug is a plug that is designed to insert into a NEMA 5-15 Electrical Socket to deliver electrical power to electrical devices. The NEMA 5-15P Electrical Plug is a three blade plug commonly found in residential and office environments within the United States.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an opening formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Radial: As used in this disclosure, the term radial refers to a direction that: 1) is perpendicular to an identified central axis; or, 2) projects away from a center point.

Ramp: As used in this disclosure, a ramp is an inclined structure that joins two parallel structures that are: 1) of different elevations; or 2) not aligned on the same plane or line.

Reservoir: As used in this disclosure, a reservoir refers to a container or containment system that is configured to store a liquid.

Roll: As used in this disclosure, the term roll refers to the motion of an object facilitated by the rotation of one or more wheels or casters.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Terminal: As used in this disclosure, a terminal is the endpoint of a conductor. A terminal can be the conducting wire itself or may have attached to is a device designed to facilitate an electrical connection.

Tube: As used in this disclosure, a tube is a hollow prism shaped device used for transporting liquids and gases. The line that connects the center of the first congruent face of the prism to the center of the second congruent face of the prism is referred to as the center axis of the tube or the centerline of the tube. When two tubes share the same centerline, they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A power tool accessory comprising:

a handle, a plurality of wheels, and a power distribution system;

wherein the plurality of wheels attach to the handle;

wherein the power distribution system attaches to the handle;

wherein the power tool accessory is for use with a disk grinder;

wherein the disk grinder further comprises a grinder motor and a grinding disk;

wherein the disk grinder attaches to the handle;

wherein the disk grinder attaches to the power tool accessory such that the grinding disk can be used to grind or polish a supporting surface;

wherein the plurality of wheels rolls the disk grinder over the supporting surface;

wherein the power distribution system is an electrical switching and safety system that transfers electrical energy from an external power source to the disk grinder;

wherein the handle manipulates the disk grinder;

wherein the handle comprises a canted pipe, an end grip, and a side grip;

wherein the end grip and the side grip attach to the canted pipe;

wherein the canted pipe is further defined with a first cant and a second cant;

wherein the plurality of wheels, the power distribution system, and the disk grinder attach to the canted pipe;

wherein the canted pipe comprises a grinder yoke, an extension structure, and a grip yoke;

wherein the center axis of the grinder yoke is parallel to a supporting surface;

wherein the grip yoke is a raised structure;

wherein the center axis of the grip yoke is parallel to the center axis of the grinder yoke;

wherein the plurality of wheels and the disk grinder attach to the grinder yoke;

wherein the grinder yoke comprises a first fastener, a second fastener, and associated hardware;

wherein the associated hardware attaches to the first fastener and the second fastener;

wherein the first fastener attaches the disk grinder to the grinder yoke;

wherein the second fastener attaches the disk grinder to the grinder yoke;

wherein the first fastener attaches to the superior side of the grinder yoke;

wherein the second fastener attaches to the superior side of the grinder yoke;

wherein the plurality of wheels comprises a first wheel and a second wheel;

wherein the first wheel attaches to the grinder yoke;

wherein the second wheel attaches to the grinder yoke;

wherein the canted pipe is further defined with a first pipe, a second pipe, a third pipe, a first 45-degree elbow, and a second 45-degree elbow;

wherein the first 45-degree elbow, and the second 45-degree elbow interconnect the first pipe, the second pipe, and the third pipe wherein the first pipe is further defined with a first port and a second port;

wherein the second pipe is further defined with a third port and a fourth port;

wherein the third pipe is further defined with a fifth port and a sixth port;

wherein the first 45-degree elbow is further defined with a seventh port and an eighth port;

wherein the second 45-degree elbow is further defined with a ninth port and a tenth port.

2. The power tool accessory according to claim 1 wherein the first cant is an acute angle formed between the center axis of the first pipe and the second pipe;

wherein the second cant is an acute angle formed between the center axis of the third pipe and the second pipe;

wherein the center axis of the first pipe, the second pipe, the third pipe, the first 45-degree elbow, and the second 45-degree elbow share the same plane.

3. The power tool accessory according to claim 2
wherein the power distribution system comprises a first cable, a second cable, a plug, a ground fault interrupter, and a master switch;
wherein the first cable, the second cable, the plug, the ground fault interrupter, and the master switch are electrically interconnected.

4. The power tool accessory according to claim 3
wherein the first cable is an electrical cable comprising two or more metal wire conductors;
wherein the second cable is an electrical cable comprising two or more metal wire conductors;
wherein the first cable is further defined with a first termination, a second termination, a third termination, and a fourth termination;
wherein the first termination and the second termination form a first conductor of the first cable;
wherein the third termination and the fourth termination form a second conductor of the first cable;
wherein the second cable is further defined with a fifth termination, a sixth termination, a seventh termination, and an eighth termination;
wherein the fifth termination and the sixth termination form a third conductor of the second cable;
wherein the seventh termination and the eighth termination form a fourth conductor of the second cable;
wherein the plug is an electrical device that connects the power distribution system to an external power source;
wherein the external power source is further defined with a hot connection and a neutral connection;
wherein the hot connection is a connection to the external power source that provides an alternating voltage potential;
wherein the neutral connection is a connection to the external power source that provides a constant voltage potential;
wherein the ground fault interrupter is an electrical device that disables the operation of the power tool accessory should an electrical ground fault be detected;
wherein the master switch is a single pole single throw maintained switch;
wherein the master switch enables and disables the operation of the power tool accessory.

5. The power tool accessory according to claim 4
wherein the first pipe is a cylindrical metal pipe;
wherein the second pipe is a cylindrical metal pipe;
wherein the third pipe is a cylindrical metal pipe;
wherein the outer diameters of the first pipe, the second pipe, and the third pipe are identical;
wherein the first 45-degree elbow is a cylindrical metal 45-degree elbow;
wherein the inner diameter of the first 45-degree elbow is sized to receive the first pipe and the second pipe;
wherein the second 45-degree elbow is a cylindrical metal 45-degree elbow;
wherein the inner diameter of the second 45-degree elbow is sized to receive the third pipe and the second pipe.

6. The power tool accessory according to claim 5
wherein the first fastener is a pipe rail tie;
wherein the second fastener is a pipe rail tie;
wherein the associated hardware is used to secure the first fastener and the second fastener to the disk grinder;
wherein the associated hardware comprises nuts and bolts;
wherein the end grip is a non-slip grip;
wherein the side grip is a cylindrical shaft;
wherein the side grip mounts perpendicularly to the end grip.

7. The power tool accessory according to claim 6
wherein the associated hardware secures the disk grinder to the first fastener and the second fastener;
wherein the first wheel attaches to the first 45-degree elbow;
wherein the second wheel attaches to the first 45-degree elbow;
wherein the second port of the first pipe attaches to the seventh port of the first 45-degree elbow;
wherein the third port of the second pipe attaches to the eighth port of the first 45-degree elbow;
wherein the fourth port of the second pipe attaches to the ninth port of the second 45-degree elbow;
wherein the fifth port of the fourth port attaches to the tenth port of the second 45-degree elbow;
wherein the end grip attaches to the sixth port of the third pipe;
wherein the end grip slides over the sixth port;
wherein the first 45-degree elbow forms the first cant of the canted pipe;
wherein the second 45-degree elbow forms the second cant of the canted pipe;
wherein the side grip attaches to the face of the second pipe such that the grip projects radially away from the side grip projects radially away from the second pipe;
wherein a plurality of cable ties attach the first cable to the second pipe;
wherein the plurality of cable ties attach the second cable to the second pipe;
wherein the second termination of the first cable electrically connects to the ground fault interrupter;
wherein the fourth termination of the first cable electrically connects to the ground fault interrupter;
wherein the ground fault interrupter electrically connects to the master switch;
wherein the master switch electrically connects to the fifth termination of the second cable;
wherein the ground fault interrupter electrically connects to the seventh termination of the second cable;
wherein the sixth termination of the second cable electrically connects to the grinder motor;
wherein the eighth termination of the second cable electrically connects to the grinder motor.

8. The power tool accessory according to claim 4
wherein the power tool accessory further comprises a reservoir, a pump, and a hose;
wherein the reservoir and the pump attach to the extension structure using a plurality of cable ties;
wherein the hose attaches to the extension structure and the grinder yoke using the plurality of cable ties.

9. The power tool accessory according to claim 8
wherein the first pipe is a cylindrical metal pipe;
wherein the second pipe is a cylindrical metal pipe;
wherein the third pipe is a cylindrical metal pipe;
wherein the outer diameters of the first pipe, the second pipe, and the third pipe are identical;
wherein the first 45-degree elbow is a cylindrical metal 45-degree elbow;
wherein the inner diameter of the first 45-degree elbow is sized to receive the first pipe and the second pipe;
wherein the second 45-degree elbow is a cylindrical metal 45-degree elbow;
wherein the inner diameter of the second 45-degree elbow is sized to receive the third pipe and the second pipe;
wherein the first fastener is a pipe rail tie;

wherein the second fastener is a pipe rail tie;

wherein the associated hardware is used to secure the first fastener and the second fastener to the disk grinder;

wherein the associated hardware comprises nuts and bolts;

wherein the end grip is a non-slip grip;

wherein the side grip is a cylindrical shaft;

wherein the side grip mounts perpendicularly to the end grip;

wherein the plug is a NEMA 5-15 electrical plug;

wherein the external power source is the national electric grid.

10. The power tool accessory according to claim 9 wherein the associated hardware secures the disk grinder to the first fastener and the second fastener;

wherein the first wheel attaches to the first 45-degree elbow;

wherein the second wheel attaches to the first 45-degree elbow;

wherein the second port of the first pipe attaches to the seventh port of the first 45-degree elbow;

wherein the third port of the second pipe attaches to the eighth port of the first 45-degree elbow;

wherein the fourth port of the second pipe attaches to the ninth port of the second 45-degree elbow;

wherein the fifth port of the fourth port attaches to the tenth port of the second 45-degree elbow;

wherein the end grip attaches to the sixth port of the third pipe;

wherein the end grip slides over the sixth port;

wherein the first 45-degree elbow forms the first cant of the canted pipe;

wherein the second 45-degree elbow forms the second cant of the canted pipe;

wherein the side grip attaches to the face of the second pipe such that the grip projects radially away from the side grip projects radially away from the second pipe;

wherein the plurality of cable ties attach the first cable to the second pipe;

wherein the plurality of cable ties attach the second cable to the second pipe;

wherein the plug electrically connects the hot connection of the external power source to the first termination of the first cable;

wherein the plug electrically connects the neutral connection of the external power source to the third termination of the first cable;

wherein the second termination of the first cable electrically connects to the ground fault interrupter;

wherein the fourth termination of the first cable electrically connects to the ground fault interrupter;

wherein the ground fault interrupter electrically connects to the master switch;

wherein the master switch electrically connects to the fifth termination of the second cable;

wherein the ground fault interrupter electrically connects to the seventh termination of the second cable;

wherein the sixth termination of the second cable electrically connects to the grinder motor;

wherein the eighth termination of the second cable electrically connects to the grinder motor.

* * * * *